US005902562A

United States Patent [19]

Lagasse et al.

[11] Patent Number: 5,902,562

[45] Date of Patent: May 11, 1999

[54] METHOD FOR THE PREPARATION OF HIGH SURFACE AREA HIGH PERMEABILITY CARBONS

[75] Inventors: Robert R. Lagasse; John L. Schroeder, both of Albuquerque, N.M.

[73] Assignee: Sandia Corporation, Livermore, Calif.

[21] Appl. No.: 08/960,112

[22] Filed: Oct. 27, 1997

Related U.S. Application Data

[63] Continuation of application No. 08/576,794, Dec. 21, 1995, abandoned.

[51] Int. Cl.[6] ..... D01F 9/12

[52] U.S. Cl. ..... 423/445 R; 423/447.1

[58] Field of Search ..... 423/445 R, 447.4, 423/447.1; 264/29.7, 28; 502/418, 436

[56] References Cited

U.S. PATENT DOCUMENTS

| | | | |
|---|---|---|---|
| 3,937,775 | 2/1976 | Honkiri et al. | 423/445 R |
| 4,046,709 | 9/1977 | Yuki | 502/437 |
| 4,420,415 | 12/1983 | Yuki et al. | 502/180 |
| 4,572,858 | 2/1986 | Young | 264/51 |
| 4,775,655 | 10/1988 | Edwards et al. | 502/416 |
| 4,820,681 | 4/1989 | Chang et al. | 502/418 |
| 4,832,881 | 5/1989 | Arnold et al. | 264/29.7 |
| 5,021,462 | 6/1991 | Alfred et al. | 521/63 |
| 5,071,820 | 12/1991 | Quinn et al. | 502/434 |
| 5,208,003 | 5/1993 | Simandl et al. | 423/445 |
| 5,260,855 | 11/1993 | Kaschmitter et al. | 361/502 |
| 5,431,864 | 7/1995 | Rao et al. | 264/29.5 |
| 5,461,023 | 10/1995 | Chang et al. | 502/416 |

*Primary Examiner*—Steven Bos
*Assistant Examiner*—Stuart L. Hendrickson
*Attorney, Agent, or Firm*—Timothy Evans; Kurt C. Olsen

[57] ABSTRACT

A method for preparing carbon materials having high surface area and high macropore volume to provide high permeability. These carbon materials are prepared by dissolving a carbonizable polymer precursor, in a solvent. The solution is cooled to form a gel. The solvent is extracted from the gel by employing a non-solvent for the polymer. The non-solvent is removed by critical point drying in $CO_2$ at an elevated pressure and temperature or evaporation in a vacuum oven. The dried product is heated in an inert atmosphere in a first heating step to a first temperature and maintained there for a time sufficient to substantially cross-link the polymer material. The cross-linked polymer material is then carbonized in an inert atmosphere.

11 Claims, 2 Drawing Sheets

METHOD FOR THE PREPARATION OF HIGH SURFACE AREA HIGH PERMEABILITY CARBONS

This application is a continuation of application Ser. No. 08/576,794, filed Dec. 21, 1995, now abandoned.

STATEMENT OF GOVERNMENT INTEREST

This invention was made with Government support under contract no. DE-AC04-94AL8500 awarded by the U.S. Department of Energy to Sandia Corporation. The Government has certain rights in the invention.

BACKGROUND OF THE INVENTION

This invention pertains generally to carbon having a high surface area and particularly to monolithic carbon having a high microporosity and a high macropore volume resulting in high fluid permeability.

Porous carbon has been found to be useful in applications where high surface area (>500 $m^2/g$) is particularly desirable, among these being: battery and supercapacitor electrodes; as media for separating and purifying liquids and gases and recovery and storage of gases. Conventional high surface area carbon is generally a particulate material having particle sizes in the range of about 15 $\mu$m to 5 mm. For separations processes, this particulate carbon material is often packed into beds or columns through which a liquid or gas flows. The efficiency of particulate powder beds is reduced by the fact that particles cannot be packed to 100% of their theoretical density; there will always be some space between particles and the efficiency of the particulate bed is reduced by the interstitial spaces between the particles. Further, these spaces provide a means whereby the process fluid can flow through the bed without effectively contacting all the carbon particles. Fluids passed through columns or beds packed with carbon powder can become contaminated with small carbon particles eluted from the column or bed and entrained in the fluid.

When used as an electrode, particulate, porous carbon material is mixed with a binder and the mixture pressed into an appropriate shape. The internal resistance of carbon powder electrodes is dependent upon the extent and quality of particle-to-particle contact. As the quality and extent of these contacts decreases the internal resistance of the electrode increases which in turn degrades the performance of the electrode. Binders, generally being of higher resistance than the carbon particles they surround, will also increase the particle-to-particle resistance thereby degrading the performance of the electrodes.

It has been recognized that one way to overcome the problems associated with porous carbon powders is to develop carbon materials in the form of a continuous, monolithic structure and prepared in such a way so as to possess the desirable properties of high surface area and low electrical resistance. As illustrated in U.S. Pat. Nos. 5,260,855; 5,021,462; 5,208,003; 4,832,881; 4,806,290 and 4,775,655 carbon foams, aerogels and microcellular carbons have been developed which overcome many of the problems associated with porous carbon powders used for separations or electrodes, supra. Many of these carbons either have most of their porosity in the micropore (<2 nm) or mesopore (2–50 nm) size range and, consequently, have low permeability to liquids and gases but have surface areas that are generally on the order of several hundred $m^2/g$. Other carbons possess significant macroporosity (0.1–1 $\mu$m) and thus have increased permeability to liquids or gases but with surface areas that are typically very low (10–100 $m^2/g$). These carbons must be treated in some way in order to increase the surface area.

A composite, semipermeable membrane comprising a microporous adsorptive material supported on a porous substrate for use in separating multicomponent gas mixtures has been disclosed in U.S. Pat. No. 5,431,864. However, here, as in other methods of separating gaseous mixtures employing carbon, an activation step is required in order to increase permeability and selectivity of the carbon membrane.

In order to prepare high surface area carbons some sort of treatment is generally required to enhance the pore structure of the carbon. This step, generally termed activation, comprises heating the carbon in an oxidizing atmosphere such as air or steam. For many applications it is desirable that the porosity be tailored. In the case of adsorption of gases, it is known that pore size is a critical parameter of the adsorption process, i.e., the pore size should closely approximate the size of the gas molecule to be adsorbed. Thus, for greater adsorption of gases above their critical temperature the adsorbent should be microporous rather than macroporous. However, conventional methods of activating carbon are not pore-size specific. The use of oxidizing agents such as steam or heating the carbon in the presence of an oxidizing agent such as air increases both the macro as well as the microporosity of the carbon. The relationship between pore size distribution and the absorptive properties of carbons as well as a critique of activation methods is discussed in U.S. Pat. No. 5,071,820. As pointed out therein the activation process can require many cycles before the desired pore size distribution is achieved. Which, while the activation process is necessary for many applications, makes it very unattractive because of the long times required for the process to be accomplished.

As discussed earlier, a class of carbons, namely carbon foams, aerogels and microcellular carbons has been developed which overcomes many of the problems associated with carbon powders used for separations or electrodes processes. However, these carbons are typically derived from polyacrylonitrile (PAN) or PAN-based polymers and as such require a special processing scheme, namely a pretreatment or "preoxidation" step wherein the PAN polymer precursor material is carefully heated in an oxygen containing atmosphere, typically air, in order to stabilize the precursor material prior to the pyrolization step. Without this pretreatment or "preoxidation" step, carbonization of the PAN or PAN-based precursor material occurs with significant degradation of the polymeric material leading to low molecular weight fragments being formed in preference to carbon with a consequent low carbon yield. Because the pretreatment step is quite exothermic, failure to carry out the pretreatment step without careful control of processing conditions can lead to the PAN or PAN-based polymer precursor becoming so hot it may fuse, decompose or burn. While PAN or PAN-based polymers can produce monolithic carbon having desirable properties, the necessity for a carefully controlled pretreatment step prior to carbonization is a significant economic detriment to this method of preparing carbon for electrodes or separations processes.

For the reasons set forth above, there has been a particular need to develop a carbon material that has a monolithic structure, the high macropore volume associated with high permeability for fluids and a high surface area composed principally of microporosity, a tailored pore size distribution, and does not require either a carefully controlled pretreatment process in an oxidizing atmosphere to prepare the carbon material or an uncontrollable activation process to achieve high surface area. Responsive to these needs, a novel processing method has been developed for producing porous carbon materials for uses such as, but not limited to, electrodes for batteries and supercapacitors, for separating and purifying fluids and recovering and storing gases. Polymer precursor materials processed in accordance with the present invention can yield porous monolithic carbon materials which possess both high permeability (high macropore volume) and high surface area, wherein the high surface area is the result of microporosity (pores <2 nm in diameter), without the use of an activation step.

SUMMARY OF THE INVENTION

The present invention provides methods for processing carbonizable, polymeric materials to produce porous monolithic carbon materials having a high macropore volume and thus high fluid permeability and a tailored porosity providing a high surface area, resulting from the presence of microporosity (pores <2 nm in diameter), without the need for a carefully controlled pretreatment process in an oxidizing atmosphere to prepare the carbon material or an uncontrollable activation process to achieve high surface area. In contrast to existing particulate carbon materials, the high surface area carbon produced by the method of the present invention is in the form of a high permeability monolith having typical dimensions of a few centimeters. The microstructure of this carbon material contains interconnected 1 $\mu$m pores (macropores) that provide facile access to the interior and provide high permeability. The wails of the 1 $\mu$m pores consist of interconnected flakes. It is these walls that contain nanometer size pores (microporosity) that produce high surface area and high capacity for absorbing liquids and gases. Characterization of the porous monoliths produced by the method disclosed herein, showed a surface area of >1000 $m^2/g$ containing 0.4 $cm^3/g$ of pores smaller than 1 nm in size.

The carbon materials of the present invention can be prepared by dissolving a carbonizable polymer precursor material, such as poly(vinyliene chloride) in a suitable solvent. The solution is cooled to form a gel. Following gel formation, the solvent can be extracted by contacting the gel with a nonsolvent, i.e., a liquid in which the polymer has negligible solubility but in which the solvent has a high solubility. After the solvent has been removed, the residual polymer foam is dried. The dried foam is pyrolized in an inert atmosphere by means of a two-step process wherein the foam is first caused to cross-link at a temperature of about 150° C. thereby raising its fusion temperature and then carbonized at a temperature of about 750° C. The method disclosed herein offers the further advantage that there is no need for pretreating the polymer precursor material in an oxygen containing atmosphere prior to the carbonization step which carries the risk that the polymer precursor material could fuse or burn unless the pretreatment process is carefully controlled. Another advantage that the present invention offers is that it provides a high surface area carbon material directly without the need for activating the carbon product, by heating in steam or an oxidizing atmosphere, in order to produce higher surface areas. It will be appreciated that by simply heating a polymer precursor material having a tailored pore size in a controlled fashion in an inert atmosphere which serves to cross-link the polymer precursor material thereby increasing its glass transition (melting) temperature, the method of the present invention provides a significant improvement over existing methods for producing high permeability, high surface area carbon materials.

DETAILED DESCRIPTION OF THE INVENTION

Figure 1:
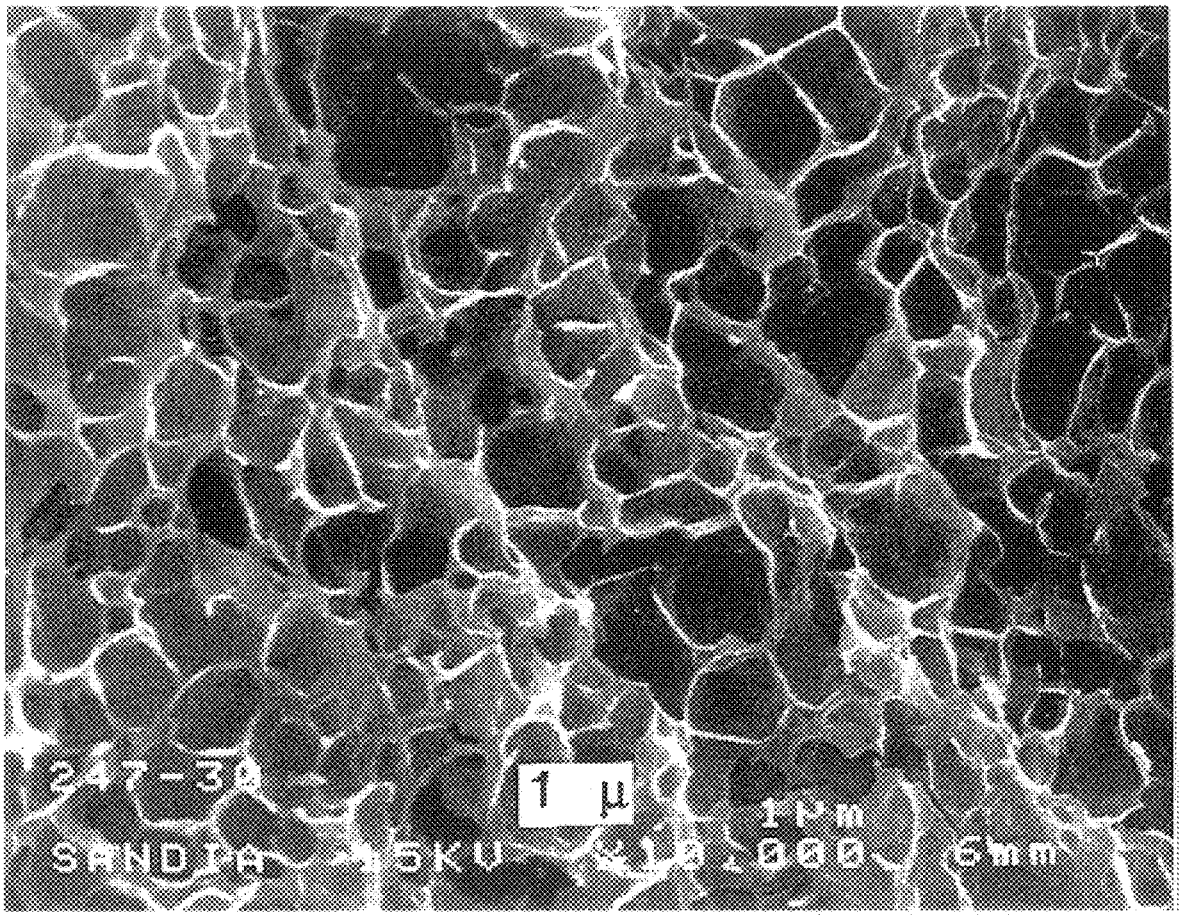
FIG. 1 shows the microstructure of a high surface area high permeability carbon material produced by the method of the present invention.

The present invention provides methods for producing high surface area, high permeability, monolithic carbon materials useful for battery and supercapacitor electrodes, as media for separating and purifying liquids and gases, and for the recovery and storage of gases, from carbonizable polymer precursor materials. The process disclosed herein provides a method for producing carbon materials having a tailored porosity, including a high volume of both macroporosity (pores 0.1–1 $\mu$m) and microporosity (pores <2 nm), thereby providing a carbon material having simultaneously high permeability and high surface area.

These carbons materials can be prepared by dissolving a carbonizable polymer precursor material, preferably poly (vinylidene chloride) (PVDC) in a solvent, preferably a mixture of 1-methyl-2-pyrrolidinone and tetrahydronapthalene. Other useful polymer precursor materials comprise copolymers of vinylidene chloride with comonomers such as vinyl chloride, acrylonitrile, ethyl acrylate, butyl acrylate, methyl acrylate, methyl methacrylate, either alone or in combination. Other useful solvents comprise acetyl piperidine, tetra methylene sulfoxide and any aromatic hydrocarbon having a boiling temperature above 120° C., such as decahydronaphthalene, and combinations thereof. The solution of polymer precursor material and solvent is cooled, preferably to a temperature of between about −10° C. and +50° C. thereby forming a gel. The solvent can be extracted from the gel, preferably by employing a nonsolvent for the polymer and critical point drying in $CO_2$ at an elevated pressure and temperature to form a dried polymer foam. The solvent can also be removed by evaporation in a vacuum oven. The dried polymer foam, containing pores 2 $\mu$m in size, is then pyrolized by a two-step process in an inert atmosphere by heating in a first heating step to a first temperature of about 150° C. and maintained there for a time sufficient to substantially cross-link the polymer. The cross-linked polymer is then heated in an inert atmosphere in a second heating step to a second temperature of about 750° C. to carbonize the polymer. Another advantage of the method of producing high surface area high permeability carbon material disclosed herein is that the carbonization temperature of 750° C. needed to get high carbon content (>92%) is lower than that used for other polymer precursor derived carbon materials.

To better understand the present invention it will now be described more fully hereinafter by way of various examples illustrative of the invention. This invention may, however, be embodied in many different forms and should not be construed as limited to the embodiment set forth herein.

EXAMPLE 1

Four grams of poly(vinylidene chloride) (PVDC) were dissolved in 40 ml of a solvent consisting of equal volumes of 1-methyl-2-pyrrolidinone and tetrahydronapthalene. This mixture was heated at 95° C. to dissolve the polymer and the mixture was then cooled to about 50° C. After 24 hrs at that temperature, the solution had transformed to a solid gel. The 1-methyl-2-pyrrolidinone and tetrahydronapthalene solvent mixture in the gel was then replaced by a non-solvent such as methanol or acetone or preferably isopropanol, by contacting the gel with a large excess of non-solvent. The isopropanol in the gel was then removed by critical point drying in $CO_2$ at about 35° C. and 1500 psi. At that stage the polymer precursor material was a PVDC monolith containing pores about 2 $\mu$m in size (based on examination of scanning electron micrographs of the PVDC structure). The PVDC gel was heated in an inert atmosphere at a temperature of about 150° C. for a period of time sufficient to cross-link the polymer precursor material (at least 12 hours) and then converted to carbon by heating the cross-linked polymer precursor material to about 750° C. for about 30 minutes.

EXAMPLE 2

The polymer precursor material was prepared exactly as set forth in EXAMPLE 1 except that the solution was cooled to −10° C. Following transformation to a gel and extraction of the solvent by isopropanol and critical point drying in $CO_2$, the PVDC gel was heated in an inert atmosphere at a temperature of about 150° C. for a period of time sufficient to cross-link the polymer precursor material (at least 12 hours) and then converted to carbon material by heating the cross-linked precursor material to about 750° C. for about 30 minutes.

In order to carbonize the dried PVDC gel to a high surface area, high permeability carbon material the following two step pyrolysis conditions can be used: 1) 2° C./min to 165° C., hold for 12 hr, 2) 1° C./min to 300° C., 3° C./min to 750° C., hold 30 min, cool. An alternate, and preferred pyrolysis schedule comprises: 1) 2° C./min to 150° C., hold 40 hr in an inert atmosphere; 2) 0.1° C./min to 280° C., 3° C./min to 750° C., hold 30 min, cool. Both schedules are designed to raise the fusion (or glass transition temperature) of the polymer precursor material by initially heating the polymer precursor material to a temperature below the crystal melting temperature, thereby causing the polymer precursor material to cross-link. Following that initial heating step, conversion of the polymer precursor material to a high surface area, high permeability carbon material can be done without destroying the macropore structure built into the polymer.

From the foregoing examples of pyrolysis schedules, one skilled in the art can readily ascertain the essential characteristics of the pyrolysis process of present invention. These examples are intended to be illustrative of the present invention and are not to be construed as limitations or restrictions thereon.

Referring now to FIG. 1, the microstructure of the carbon material produced by the method disclosed herein is seen to contain interconnected pores 1 $\mu$m in diameter that provide facile access to the interior and provide high permeability. The walls of the 1 $\mu$m pores consist of interconnected flakes. It is these walls that contain the nanometer size pores that produce high surface area and high capacity for absorbing liquids and gases. Although the bulk density of the PVDC precursor polymer material is insensitive to the gelation temperature, the density of the carbon material decreases substantially when the gelation temperature increases from −10 to +50° C., as shown in Table 1. These changes in the density appear to be reflected in corresponding changes in the macroporosity, i.e., as the density increases the macroporosity decreases. Table 1 summarizes the results of measurements of density, surface area, total pore volume and pore volume distribution for PVDC carbon gelled at two temperatures −10 and +50° C., an R/F emulsion-derived carbon and an activated PAN-derived carbon.

TABLE I

Pore Structure of Carbon Monoliths

| | PVDC Carbon | PVDC Carbon | R/F Emulsion Carbon | Activated PAN C |
|---|---|---|---|---|
| Gelation T (° C.) | +50 | −10 | | |
| BET Surface ($m^2$/g) | 1050 | 1060 | 490 | 450 |
| Bulk Density (g/cc) | 0.33 | 0.61 | 0.30 | 0.74 |
| Total Pore V (cc/g) | 2.58 | 1.18 | 2.82 | 0.84 |
| Micropore V (cc/g) | 0.37 | 0.37 | 0.15 | 0.16 |
| Mesopore V (cc/g) | 0.02 | 0.01 | 0.48 | 0.03 |
| Macropore V (cc/g) | 2.18 | 0.80 | 2.20 | 0.66 |
| Micro + Meso Pore Area($m^2$/g) | 1360 | 1330 | 530 | 530 |

The BET surface area of both PVDC derived carbon materials is essentially the same 1055+/−5 $m^2$/g. However, there is a significant decrease in the macropore volume for the carbon material produced from the polymer precursor material gelled at −10° C. as contrasted to the polymer precursor material gelled at +50° C. On the other hand both PVDC derived carbons show a significantly larger BET surface area and micropore volume than either of the other two carbons.

Figure 3:
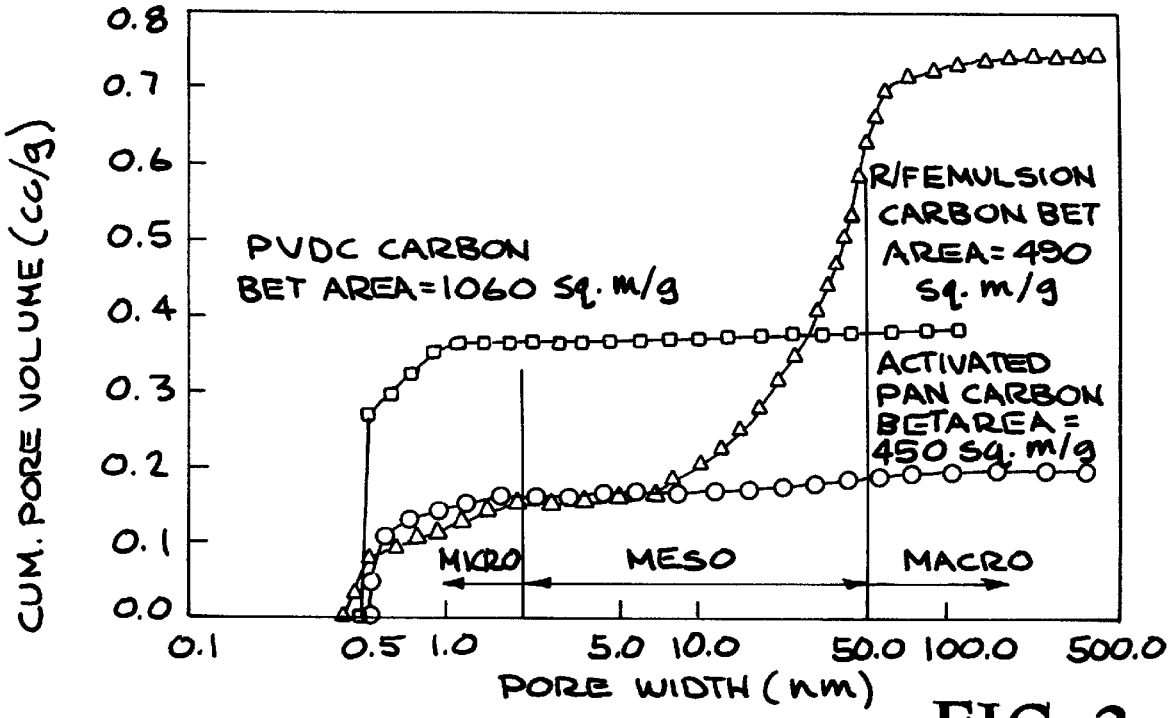
FIG. 3 shows the cumulative distribution of pore volume for slit-shaped pores of different sizes in PVDC carbon, R/F emulsion carbon and activated PAN derived carbon.
Figure 2:
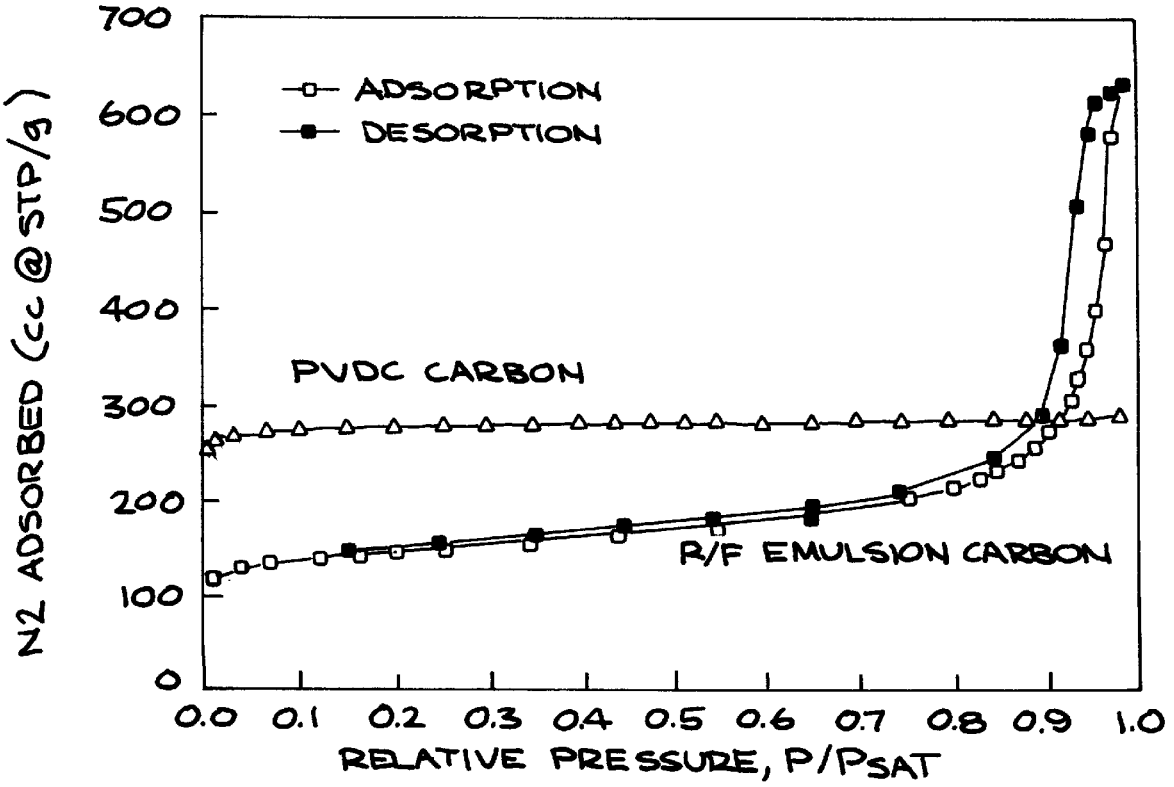
FIG. 2 shows adsorption and desorption isotherms of nitrogen at 76° K. for poly(vinylidene) chloride (PVDC) derived carbon and a typical resorcinol-formaldehyde (R/F) emulsion derived carbon.

FIG. 2 shows the adsorption/desorption isotherms for nitrogen at 76° K. for PVDC and R/F carbon. The R/F carbon showed hysteresis which signifies the presence of substantial porosity in the mesopore range (2–50 nm) in the sample in contrast to PVDC carbon. This is shown more clearly in FIG. 3 wherein the cumulative distribution of pore volume for slit shaped pores for the samples of Table 1 is depicted (note that this cumulative distribution does not include the 1 $\mu$m macropores in the material) The pore size distribution was essentially the same for both PVDC derived carbons, regardless of the gelation temperature. The PVDC carbons had a substantial volume of pores with a width smaller than 1 nm but essentially no mesoporosity. In contrast, the R/F carbon had a considerably smaller volume of micropores, but a substantial volume of mesopores. The activated PAN derived carbon had a significantly smaller volume of micropores than the PVDC carbon and little mesoporosity.

By using the method of preparing carbon materials disclosed herein it is possible to tailor the total pore volume and especially the ratio of micropore to macropore volume for various engineering applications by varying the raw material and processing conditions.

From the foregoing description and examples, one skilled in the art can readily ascertain the essential characteristics of the present invention. The description and examples are intended to be illustrative of the present invention and are not to be construed as limitations or restrictions thereon, the invention being delineated in the following claims.

We claim:

1. A method for producing a porous carbon material comprising the steps of:

a) dissolving poly(vinylidene chloride) in a solvent to form a solution;

b) cooling the solution to form a gel;

c) extracting the solvent from the gel to form a polymer precursor, said polymer precursor comprising a macroporous structure;

d) cross-linking said polymer precursor to form a cross-linked polymer, said step of cross-linking further comprising the steps of:

1) heating the polymer precursor in an inert atmosphere in a first heating step to a first temperature of about 165° C., said first temperature sufficient to initiate a cross-linking reaction in said polymer precursor; and 2) maintaining said first temperature for a first period of time, said first period of time at least about 12 hours, said first period of time sufficient to allow said cross-linking reaction to proceed to substantial completion; and e) carbonizing the cross-linked polymer by heating said polymer to a second temperature while maintaining said inert atmosphere, said second temperature being about 750° C., said second temperature being maintained for a second period of time of at least about 30 minutes, said second time period being sufficient to convert substantially all of the cross-linked polymer to carbon, said step of cross-linking preventing destruction of said macroporous structure during said step of carbonization.

2. The method of claim 1, wherein the step of dissolving further includes dissolving a mixture of poly(vinylidene chloride) and at least one co-monomer selected from the group consisting of vinyl chloride, acrylonitrile, methyl acrylate, ethyl acrylate, butyl acrylate, methyl methacrylate.

3. The method of claim 1 wherein the step of carbonizing further comprises heating the cross-linked polymer at a rate of about 3° C./min.

4. The method of claim 1 wherein the solvent is a mixture of 1-methyl-2-pyrrolidinone and tetrahydronaphthalene.

5. The method of claim 1 wherein the solvent is selected from the group consisting of acetyl piperidine, tetramethylene sulfoxide, decahydronaphthalene, and aromatic hydrocarbons having a boiling point greater than 120° C. and mixtures thereof.

6. The method of claim 1 wherein the step of cooling further comprises cooling the solution to a temperature within the range of between −10° C. and +50° C., said cooling temperature for controlling the macropore volume of the polymer precursor wherein a higher cooling temperature produces an increase in macropore volume.

7. The method of claim 1 wherein said step of extracting comprises contacting the gel with a nonsolvent selected from the group consisting of acetone, methanol and isopropanol and mixtures thereof.

8. The method of claim 1 wherein said step of extracting further includes drying by critical point drying in $CO_2$.

9. The method of claim 8 wherein critical point drying is done in $CO_2$ at a temperature of less than about 50° C. and a pressure of about 1500 psi.

10. The method of claim 1 wherein the step of extracting is by evaporation in a vacuum oven.

11. The method of claim 1 wherein the step of heating further comprises heating at a rate of about 2–4° C./min.

* * * * *